US007882779B2

(12) United States Patent
Higuchi

(10) Patent No.: US 7,882,779 B2
(45) Date of Patent: Feb. 8, 2011

(54) VARIABLE DISPLACEMENT INCLINED PLATE TYPE COMPRESSOR

(75) Inventor: Teruo Higuchi, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 372 days.

(21) Appl. No.: 12/161,725

(22) PCT Filed: Jan. 11, 2007

(86) PCT No.: PCT/JP2007/050203

§ 371 (c)(1),
(2), (4) Date: Jul. 22, 2008

(87) PCT Pub. No.: WO2007/086256

PCT Pub. Date: Aug. 2, 2007

(65) Prior Publication Data

US 2010/0232987 A1 Sep. 16, 2010

(30) Foreign Application Priority Data

Jan. 24, 2006 (JP) ..... 2006-014741

(51) Int. Cl.
*F01B 31/10* (2006.01)
*F01B 3/00* (2006.01)

(52) U.S. Cl. ..... 92/153; 92/71

(58) Field of Classification Search ..... 91/499, 91/500, 501, 502, 503, 504, 505; 92/57, 92/71, 153; 417/269
See application file for complete search history.

(56) References Cited

U.S. PATENT DOCUMENTS 5,046,403 A * 9/1991 Riedhammer ..... 92/71
5,495,789 A 3/1996 Ogura et al.

FOREIGN PATENT DOCUMENTS

JP S56-154582 U 11/1981
JP H06-069371 U 9/1994
JP H08-159024 A 6/1996
WO 03104653 A1 12/2003

OTHER PUBLICATIONS

Japanese Patent Office, International Search Report (International Patent Application No. PCT/JP2007/050203—couterpart to above-captioned patent application), mailed Apr. 10, 2007.

* cited by examiner

*Primary Examiner*—Michael Leslie
(74) *Attorney, Agent, or Firm*—Baker Botts L.L.P.

(57) ABSTRACT

A variable displacement inclined plate type compressor comprising a spindle, an inclined plate provided to be inclinable relative to the spindle and rotating together with the spindle, a pair of shoes arranged to hold the inclined plate therebetween, and a piston coupled with the inclined plate through the pair of shoes, wherein the quantity of stroke of the piston is determined depending on the inclination angle of the inclined plate. In the sliding surface of the inclined plate with which the planar part of the shoe comes into contact, a groove is provided such that the contact area of the shoe and the sliding surface of the inclined plate when the inclination angle of the inclined plate is minimum becomes smaller than that when the inclination angle of the inclined plate is maximum. In such a structure, power consumption can be reduced during low displacement operation without damaging reliability of the compressor.

18 Claims, 3 Drawing Sheets

VARIABLE DISPLACEMENT INCLINED PLATE TYPE COMPRESSOR

CROSS-REFERENCE TO RELATED APPLICATIONS

This application is the National Stage of International Patent Application No. PCT/JP2007/050203, filed Jan. 11, 2007, which claims the benefit of Japanese Patent Application No. 2006-014741, filed Jan. 24, 2006, the disclosures of which are incorporated herein by reference in their entirety.

TECHNICAL FIELD OF THE INVENTION

The present invention relates to a variable displacement inclined plate type compressor, and specifically, to improvement of the structure of the engaging portion between the inclined plate and the shoe.

BACKGROUND ART OF THE INVENTION

As a variable displacement compressor provided in a refrigeration cycle, etc., an inclined plate type compressor, for example, a variable displacement inclined plate type compressor added with a clutchless function is known. This variable displacement inclined plate type compressor is formed, for example, as depicted in FIG. 1. Namely, variable displacement inclined plate type compressor 1 has a spindle 2 and an inclined plate 3 provided to be inclinable relative to spindle 2, and the inclined plate 3 is rotated together with spindle 2 in a crank chamber 6 via a rotor 4 fixed to spindle 2 and a link mechanism 5. A pair of shoes 7, 7 are provided in a recessed portion 9 formed at one end of a piston 8 so as to hold inclined plate 3 therebetween, and piston 8 coupled with inclined plate 3 through the pair of shoes 7, 7 is reciprocated accompanied with the rotation of inclined plate 3. The quantity of stroke of piston 8 is determined depending on the inclination angle of inclined plate 3, thereby determining the displacement of compressor 1. Namely, when the inclination angle of inclined plate 3 is maximum, the displacement becomes maximum, and when the displacement is minimum, the inclination angle of inclined plate 3 is controlled at a condition of almost zero degree. Where, symbol 10 in FIG. 1 indicates a suction chamber of a fluid (for example, refrigerant) to be compressed, and symbol 11 indicates a discharge chamber of the compressed fluid, respectively.

In the above-described variable displacement inclined plate type compressor, because the inclination angle of inclined plate 3 becomes almost zero degree when the displacement is minimum and the stroke of piston 8 also becomes almost zero, the inertial resistance and the sliding resistance of the piston approaches zero as much as possible. On the contrary, shoe 7 always slides relatively to inclined plate 3, and it is known that the power consumption due to the viscosity resistance of lubricating oil.

In order to improve the lubricating performance on the sliding surface of the inclined plate, a structure is known wherein a plurality of grooves extending in the radial direction of the inclined plate are provided on the inclined plate, in particular, on the sliding surface with the shoe (Patent document 1). In this structure, however, a gap between the shoe and the inclined plate may discontinuously vary by the grooves extending in the radial direction of the inclined plate, and at worst, the shoe may float relative to the inclined plate. As the result, the operation of the piston may become unstable, and the property and reliability of the compressor may be reduced.

Patent document 1: JP-A-8-159024

DISCLOSURE OF THE INVENTION

Problems to be Solved by the Invention

Accordingly, an object of the present invention is to provide a variable displacement inclined plate type compressor which can reduce its power consumption particularly at the time of minimum displacement operation without damaging reliability.

Means for Solving the Problems

To achieve the above-described object, a variable displacement inclined plate type compressor according to the present invention comprises a spindle, an inclined plate provided to be inclinable relative to the spindle and rotating together with the spindle, a pair of shoes arranged to hold the inclined plate therebetween, and a piston coupled with the inclined plate through the pair of shoes, wherein a quantity of stroke of the piston is determined depending on an inclination angle of the inclined plate, and the compressor is characterized in that the compressor has a groove in a sliding surface of the inclined plate with which a planar part of the shoe comes into contact, and the groove is formed such that a contact area of the shoe and the sliding surface of the inclined plate when the inclination angle of the inclined plate is minimum becomes smaller than a contact area of the shoe and the sliding surface of the inclined plate when the inclination angle of the inclined plate is maximum.

The above-described groove may comprise a plurality of annular grooves whose centers are set at a center of the inclined plate. Although the plurality of annular grooves can be formed as grooves having widths different from each other, from the viewpoint of facilitating the processing, it is preferable to form grooves having a same width. Particularly in such a case where grooves having a same width are formed, it is preferred that the plurality of annular grooves are formed so that a width between grooves in a radially outer part of the inclined plate becomes larger than a width between grooves in a radially inner part of the inclined plate.

The widths between grooves may be increased stepwise in a radially outward direction of the inclined plate, or the widths between grooves may be increased continuously (that is, in order) in the radially outward direction of the inclined plate.

Further, it is possible to form the above-described plurality of annular grooves over substantially the entire region of the sliding surface of the inclined plate with the shoe, and as shown in the embodiment described later, it is also possible to form the above-described plurality of annular grooves only in a region positioned at a side of the center of the inclined plate.

Such a variable displacement inclined plate type compressor according to the present invention is suitable particularly as a compressor used in a refrigeration cycle of an air conditioning system for vehicles, which requires durability, etc.

EFFECT ACCORDING TO THE INVENTION

In the variable displacement inclined plate type compressor according to the present invention, since the contact area between the planar part of the shoe and the inclined plate becomes large at the time of maximum displacement and the contact area between the planar part of the shoe and the inclined plate becomes small at the time of minimum displacement, the power consumption at the time of minimum displacement can be reduced without increasing the contact pressure between the shoe and the inclined plate applied at the time of maximum displacement. Further, by forming the grooves as the annular grooves, because the gap between the shoe and the inclined plate can be maintained to be always constant without causing such a problem as aforementioned as to Patent document 1, the shoe is not floated, and the property and reliability of the compressor may be ensured.

EXPLANATION OF SYMBOLS

Figure 1:
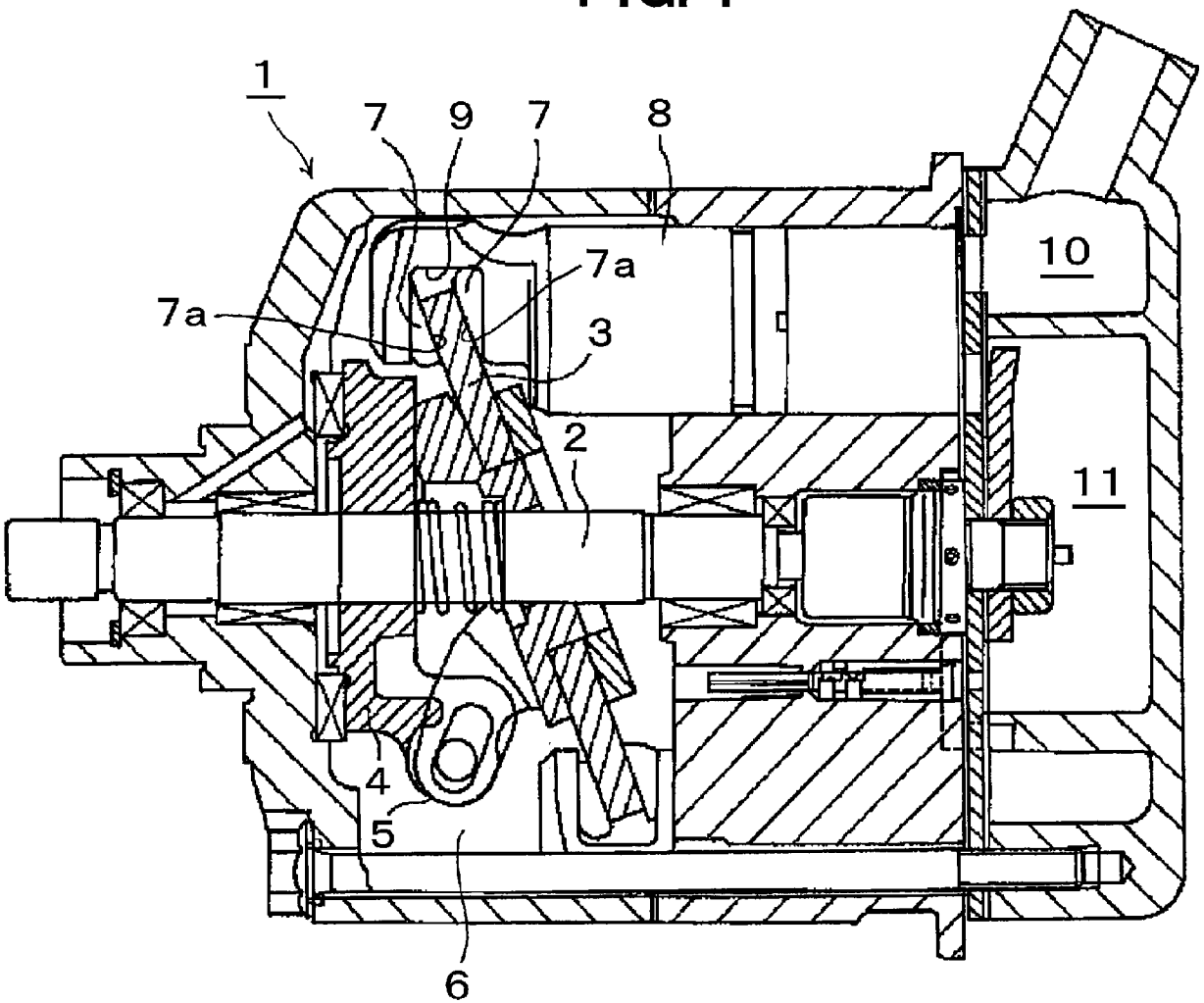
FIG. 1 is a vertical sectional view, showing an example of a basic structure of a variable displacement inclined plate type compressor capable of being applied with the present invention.

1: variable displacement inclined plate type compressor
2: spindle
3: inclined plate
3*a*: sliding surface
4: rotor
5: link mechanism
6: crank chamber
7: shoe
7*a*: planar part
8: piston
9: recessed portion
10: suction chamber
11: discharge chamber
21: center
22: groove
23: first region
24: second region

THE BEST MODE FOR CARRYING OUT THE INVENTION

Hereinafter, desirable embodiments of the present invention will be explained referring to figures.

Figure 2:
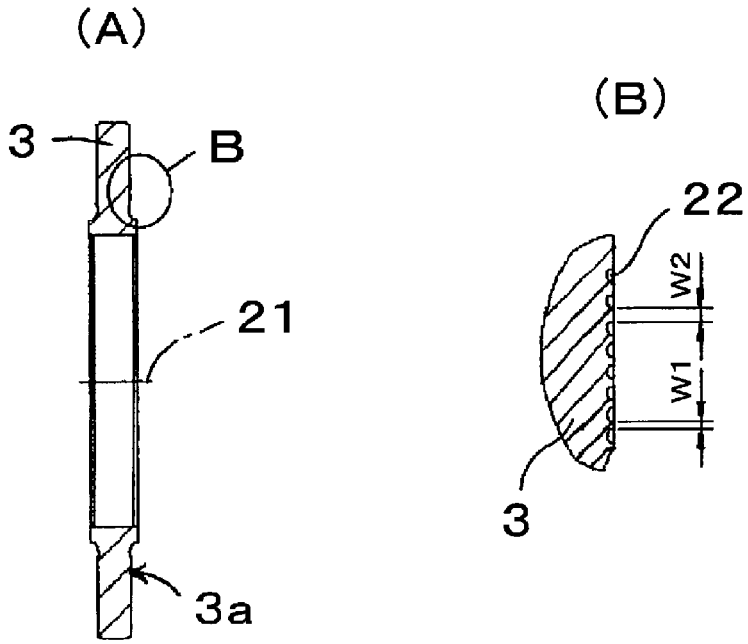
FIG. 2 shows an embodiment of a case where the present invention is applied to an inclined plate of the compressor depicted in FIG. 1, (A) is a vertical sectional view of the inclined plate, and (B) is a partial, enlarged sectional view of a portion B of (A).
Figure 3:
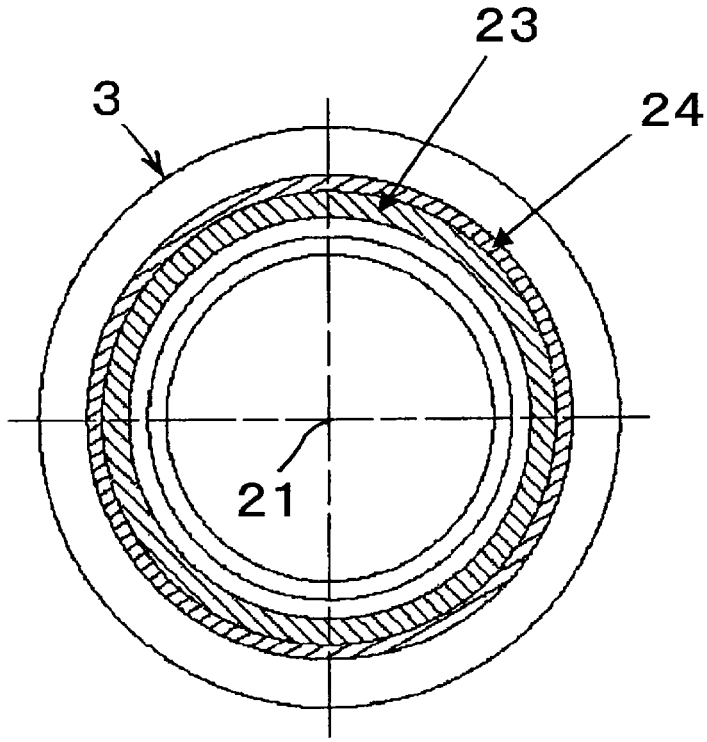
FIG. 3 is an elevational view of the inclined plate depicted in FIG. 2.

The basic structure of a variable displacement inclined plate type compressor is the same as that which has been depicted in FIG. 1. FIGS. 2 and 3 show a structure of an inclined plate portion of a variable displacement inclined plate type compressor according to an embodiment of the present invention. As depicted in FIG. 2(A) and FIG. 2(B), on a sliding surface 3*a* of inclined plate 3 with which a planar part 7*a* of shoe 7 (shown in FIG. 1) comes into contact, a plurality of grooves 22 are formed such that the contact area of shoe 7 and sliding surface 3*a* of inclined plate 3 when the inclination angle of inclined plate 3 is minimum becomes smaller than the contact area of shoe 7 and sliding surface 3*a* of inclined plate 3 when the inclination angle of inclined plate 3 is maximum. In this embodiment, these grooves 22 are formed as a plurality of annular grooves whose centers are set at center 21 of inclined plate 3.

Further, in this embodiment, the widths of the plurality of grooves 22 are identical to each other (the sectional shapes of the grooves are identical to each other), thereby facilitating the processing. In order to achieve the structure wherein the contact area of shoe 7 and sliding surface 3*a* of inclined plate 3 when the inclination angle of inclined plate 3 is minimum becomes smaller than the contact area of shoe 7 and sliding surface 3*a* of inclined plate 3 when the inclination angle of inclined plate 3 is maximum, the widths between respective grooves 22 are changed. Namely, the plurality of annular grooves 22 are formed so that a width between grooves W2 in the radially outer part of inclined plate 3 becomes larger than a width between grooves W1 in the radially inner part of inclined plate 3. In this embodiment, the widths between grooves are increased stepwise in a radially outward direction of inclined plate 3. Therefore, as depicted in FIG. 3, the region (first region 23) for the smaller width between grooves W1 in a radially inner part of inclined plate 3, and at an outer portion thereof, the region (second region 24) for the larger width between grooves W2 in a radially outer part of inclined plate 3, are formed annularly.

Figure 4:
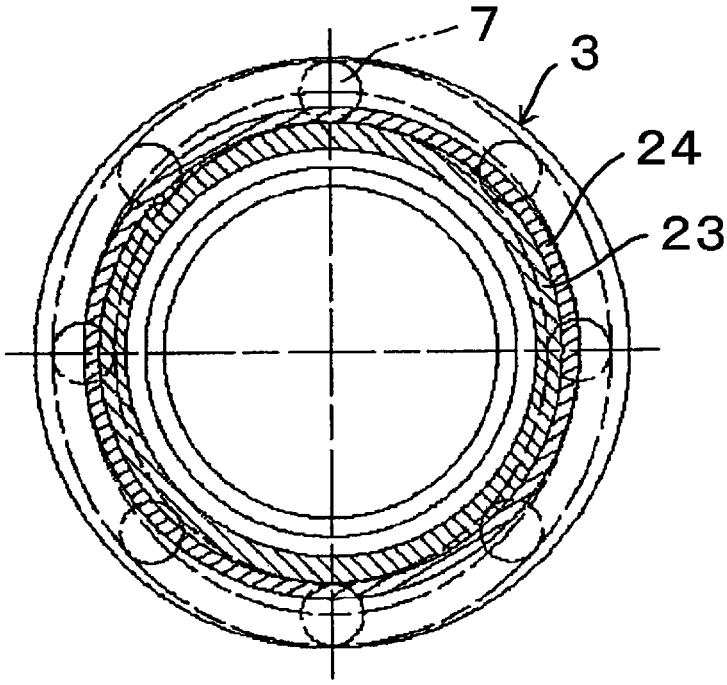
FIG. 4 is an elevational view of the inclined plate depicted in FIG. 3, showing a locus of a shoe at the time of maximum displacement.
Figure 5:
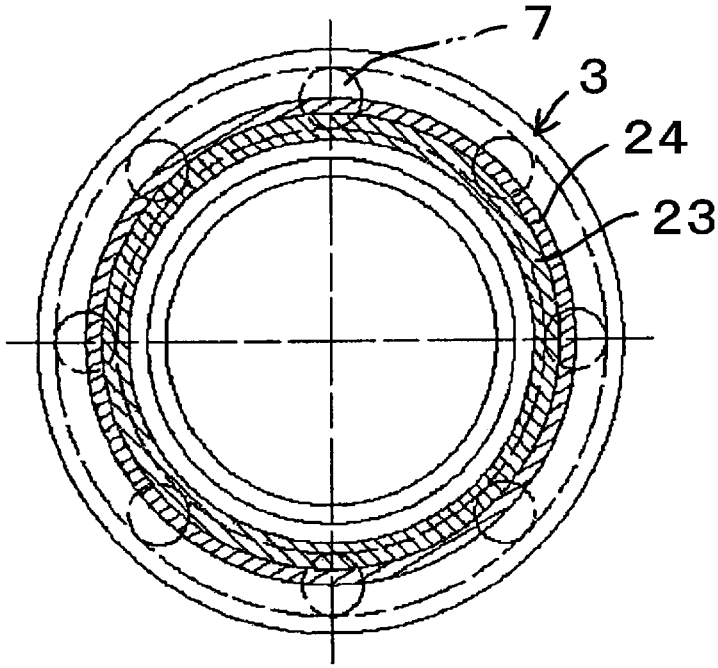
FIG. 5 is an elevational view of the inclined plate depicted in FIG. 3, showing a locus of a shoe at the time of minimum displacement.

It is not always necessary to form the forming region for the plurality of grooves 22 over the entire area of sliding surface 3*a* of inclined plate 3 with shoe 7. The loci due to the relative movement of shoe to inclined plate 3 become, for example, as shown in FIG. 4 (at the time of maximum displacement) and FIG. 5 (at the time of minimum displacement). For such loci of shoe 7, the forming region for the plurality of grooves 22 (the forming region for the above-described first region 23 and second region 24) may be set, for example, as shown in FIGS. 4 and 5. Namely, grooves 22 are formed on the region in a range of about 20% of the contact portion (sliding region) between planar part 7*a* of shoe 7 and sliding surface 3*a* of inclined plate 3 when piston is at the top dead center at that the inclination angle of inclined plate 3 becomes maximum and the load becomes highest, and when the inclination angle of inclined plate 3 is minimum, the groove forming region is set so as to be able to be enlarged up to a range of about 50% of the contact portion with planar part 7*a* of shoe 7. Then, as aforementioned, in order to facilitate the processing, it is preferable to set the shapes of respective grooves 22 to be identical, to set the width between grooves at the portion engaging with the locus of shoe 7 at the time of the piston top dead center larger (to set at W2), and to set the width between grooves at a portion inside thereof smaller (to set at W1).

As is understood from FIG. 4, at the time of maximum displacement, although the load applied from piston 8 near the top dead center of piston 8 becomes high, about 20% of the contact portion between planar part 7*a* of shoe 7 and sliding surface 3*a* of inclined plate 3 engages with the forming region of second region 24 (the region formed with grooves 22 at the larger width between grooves W2), and the contact pressure between planar part 7*a* of shoe 7 and sliding surface 3*a* of inclined plate 3 is maintained low. Further, at the time of minimum displacement, as is understood from FIG. 5, over the entire stroke of piston 8 including the portion near the top dead center, about 50% of the contact portion between planar part 7*a* of shoe 7 and sliding surface 3*a* of inclined plate 3 engages with both of the forming region of the above-described second region 24 and the forming region of first region 23 (the region formed with grooves 22 at the smaller width between grooves W1), the contact area between planar part 7*a* of shoe 7 and sliding surface 3*a* of inclined plate 3 is maintained small, and the power consumption is reduced.

Further, because these first region 23 and second region are formed by annular grooves 22, when shoe 7 slides relative to inclined plate 3 along the locus shown in FIG. 4 or FIG. 5, there does not occur a portion at which the gap between shoe 7 and inclined plate 3 is changed rapidly or discontinuously, occurrence of an inconvenience such as floating of shoe 7 may be prevented, and a stable operation, ultimately, the reliability of the compressor may be ensured.

INDUSTRIAL APPLICATIONS OF THE INVENTION

The structure of the compressor according to the present invention can be applied to any variable displacement inclined plate type compressor, and in particular, it is suitable for a variable displacement inclined plate type compressor used in a refrigeration cycle of an air conditioning system for vehicles.

The invention claimed is:

1. A variable displacement inclined plate type compressor comprising a spindle, an inclined plate provided to be inclinable relative to said spindle and rotating together with said spindle, a pair of shoes arranged to hold said inclined plate therebetween, and a piston coupled with said inclined plate through said pair of shoes, wherein a quantity of stroke of said piston is determined depending on an inclination angle of said inclined plate, characterized in that said compressor has a groove in a sliding surface of said inclined plate with which a planar part of said shoe comes into contact, and said groove is formed such that a contact area of said shoe and said sliding surface of said inclined plate when said inclination angle of said inclined plate is minimum becomes smaller than a contact area of said shoe and said sliding surface of said inclined plate when said inclination angle of said inclined plate is maximum.

2. The variable displacement inclined plate type compressor according to claim 1, wherein said groove comprises a plurality of annular grooves whose centers are set at a center of said inclined plate.

3. The variable displacement inclined plate type compressor according to claim 2, wherein said plurality of annular grooves are formed so that a width between grooves in a radially outer part of said inclined plate becomes larger than a width between grooves in a radially inner part of said inclined plate.

4. The variable displacement inclined plate type compressor according to claim 3, wherein said widths between grooves are increased stepwise in a radially outward direction of said inclined plate.

5. The variable displacement inclined plate type compressor according to claim 3, wherein said widths between grooves are increased continuously in a radially outward direction of said inclined plate.

6. The variable displacement inclined plate type compressor according to claim 2, wherein said plurality of annular grooves are formed only in a region positioned at a side of said center of said inclined plate among an annular region of said inclined plate forming said sliding surface with said shoe.

7. The variable displacement inclined plate type compressor according to claim 1, wherein said compressor is used in a refrigeration cycle of an air conditioning system for vehicles.

8. The variable displacement inclined plate type compressor according to claim 3, wherein said plurality of annular grooves are formed only in a region positioned at a side of said center of said inclined plate among an annular region of said inclined plate forming said sliding surface with said shoe.

9. The variable displacement inclined plate type compressor according to claim 4, wherein said plurality of annular grooves are formed only in a region positioned at a side of said center of said inclined plate among an annular region of said inclined plate forming said sliding surface with said shoe.

10. The variable displacement inclined plate type compressor according to claim 5, wherein said plurality of annular grooves are formed only in a region positioned at a side of said center of said inclined plate among an annular region of said inclined plate forming said sliding surface with said shoe.

11. The variable displacement inclined plate type compressor according to claim 2, wherein said compressor is used in a refrigeration cycle of an air conditioning system for vehicles.

12. The variable displacement inclined plate type compressor according to claim 3, wherein said compressor is used in a refrigeration cycle of an air conditioning system for vehicles.

13. The variable displacement inclined plate type compressor according to claim 4, wherein said compressor is used in a refrigeration cycle of an air conditioning system for vehicles.

14. The variable displacement inclined plate type compressor according to claim 5, wherein said compressor is used in a refrigeration cycle of an air conditioning system for vehicles.

15. The variable displacement inclined plate type compressor according to claim 6, wherein said compressor is used in a refrigeration cycle of an air conditioning system for vehicles.

16. The variable displacement inclined plate type compressor according to claim 8, wherein said compressor is used in a refrigeration cycle of an air conditioning system for vehicles.

17. The variable displacement inclined plate type compressor according to claim 9, wherein said compressor is used in a refrigeration cycle of an air conditioning system for vehicles.

18. The variable displacement inclined plate type compressor according to claim 10, wherein said compressor is used in a refrigeration cycle of an air conditioning system for vehicles.

* * * * *